US005899089A

United States Patent [19]

Kwon

[11] Patent Number: 5,899,089

[45] Date of Patent: May 4, 1999

[54] COOL AIR SUPPLY APPARATUS FOR FREEZER COMPARTMENT OF REFRIGERATOR

[75] Inventor: Hyuk-Jang Kwon, Incheon, Rep. of Korea

[73] Assignee: Daewoo Electronics Co., Ltd., Seoul, Rep. of Korea

[21] Appl. No.: 08/984,111

[22] Filed: Dec. 3, 1997

[30] Foreign Application Priority Data

Jun. 30, 1997 [KR] Rep. of Korea ..... 97-29912

[51] Int. Cl.[6] ..... F25D 17/04

[52] U.S. Cl. ..... 62/408; 62/441; 62/404; 62/407

[58] Field of Search ..... 62/407, 408, 441

[56] References Cited

U.S. PATENT DOCUMENTS 5,675,985 10/1997 Lee .
5,765,388 6/1998 Jeon ..... 62/408

*Primary Examiner*—Henry Bennett
*Assistant Examiner*—Melvin Jones
*Attorney, Agent, or Firm*—Smith, Gambrell & Russell; Beveridge, DeGrandi, Weilacher & Young Intellectual Property Group

[57] ABSTRACT

A cool air supply apparatus dispersedly supplies a cool air into a freezer compartment of a refrigerator. In the apparatus, an inner shell which surrounds the freezer compartment. A cross flow fan assembly is mounted under said inner shell inside the cooler chamber and blows cool air generated by an evaporator. An air distribution plate is spaced apart from the inner shell by a predetermined distance inside the freezer compartment. An air distribution plate includes a plurality of cool air outlet openings formed therein, each of the outlet openings being disposed apart from adjacent cool air outlet openings by a predetermined distance and defining a cool air supply duct with the inner shell, dispersedly supplies the cool air from said flow fan assembly into the freezer compartment through the outlet openings. In accordance with the apparatus, even through freezing objects are stored at back side of the freezer compartment, the cool air generated by the evaporator can evenly be transmitted to the inside of the freezer compartment so that temperature distribution inside the freezer compartment becomes uniform.

4 Claims, 5 Drawing Sheets

COOL AIR SUPPLY APPARATUS FOR FREEZER COMPARTMENT OF REFRIGERATOR

BACKGROUND OF THE INVENTION

1. Field of the Invention

The present invention relates to a refrigerator, and more particularly to an apparatus for dispersedly supplying cool air into a freezer compartment of a refrigerator.

2. Description of the Prior Art

Generally, a refrigerator having a freezer compartment and a refrigerating compartment is configured so that cold air which is cooled by a cooler in a cooler chamber is sent through a damper device and a cold air duct to the freezer compartment and the refrigerating compartment to cool its inner space.

U.S. Pat. No. 5,675,985 (issued to Sang-Moo Lee on Oct. 14, 1997) discloses a cool air supplying apparatus capable of dispersedly supplying cool air into a refrigerator by use of a swing plate disposed within a cool duct. The cool duct includes a main duct extending through a freezing room and a refrigerating room and at least one sub-duct communicated with the main duct and having a plurality of holes for supplying the cool air. The swing plate is disposed within the sub-duct along its longitudinal direction. A shaft is disposed within the main duct to be capable of reciprocating along its longitudinal direction and is operatively connected with the swing plate. A motor is installed at an upper portion of the main duct, and a crank is operatively connected with each of a rotary shaft of the motor and the shaft. The shaft and the swing plate are operatively connected with each other by means of a protrusion formed at a long side of the swing plate and having an U-shaped groove through which the shaft passes and pairs of collars fixed on the shaft to insert the protrusion therebetween. However, a configuration of a patent of Sang-Moo Lee is different from that of the present invention.

A conventional cool air supply apparatus 10 of a freezer compartment of a refrigerator will be described with reference to FIG. 1. FIG. 1 shows a configuration of the conventional cool air supply apparatus 10.

The conventional cool air supply apparatus 10 includes a heat insulated housing 102 which constitutes a body of the refrigerator and first and second doors 104 and 106 for opening and closing of the heat insulated housing 102. The heat insulated housing 102 consists of an inner shell 108 made of a synthetic resin, an outer shell 110 made of metal such as a coated steel plate, and a foamed heat insulating material 112 such as foamed polyurethane resin which is filled between the inner and outer shells 108 and 110. The first door 104 is provided for a freezer compartment 114, and the second door 106 is provided for a refrigerating compartment 116.

A louver 118 is disposed at the back of the freezer compartment 114, and a plurality of cool air outlet openings 120 for supplying the cool air are perforated through the louver 118. Behind the louver 118, a cooler chamber 122 is formed. An evaporator 124 such as a cooler is provide inside the cooler chamber 122 and exchanges heat with the air returned to the cooler chamber 122 from the freezer compartment 114 through both an air return outlet opening 136*a* and a freezing cool air return duct 136 will be described later. An air blower 126 such as a propeller fan is disposed above the evaporator 124 and blows a cool air in a low temperature state generated from the evaporator 124 into an inside of the freezer compartment 114 through the plurality of cool air outlet openings 120.

A cold air duct 128 extends from the freezer compartment 114 to the refrigerating compartment 116 in the longitudinal direction of the refrigerator 100 along the inner wall 129 thereof. In order for the cool air generated from the evaporator 126 to flow, a cool air flow passage is provided from the cold air duct 128 installed with the evaporator 126 therein, which is then communicated with the freezer compartment 114 and the refrigerating compartment 116. The cool air in a low temperature state generated from the evaporator 126 is also supplied to the refrigerating compartment 116 through the cold air duct 128.

A reference numeral 130 designates a horizontal partition for dividing an inner space of the heat insulating housing 102 into two sections, i.e., upper and lower sections. The section over the horizontal partition 130 serves as the freezer compartment 114 that is cooled to a freezing temperature (e.g., about −20° C.), and the section under the horizontal partition 130 serves as the refrigerating compartment 116 that is cooled to a temperature (e.g., about 3° C.) at which foods do not freeze. A first separating plate 132 is installed to the bottom of the freezer compartment 114, and a second separating plate 134 is installed to the top of the refrigerating compartment 116. A freezing cool air return duct 136 is formed between the first separating plate 132 and the horizontal partition 130, and a refrigerating cool air return duct 138 is formed between the horizontal partition 130 and the second separating plate 134.

In regard to an operation of the conventional cool air supply apparatus, cold air cooled by the evaporator 126 is supplied to the freezer compartment 114 via cold air outlet openings 120. The cold air supplied into the freezer compartment 114 is returned to the cooler chamber 116 via the freezing cool air return duct 136. The cool air is again cooled by means of the evaporator 126 so that circulation of the cool air repeats.

However, in the conventional cool air supply apparatus, the cool air cooled by the evaporator 126 is supplied to the freezer compartment 114 from the back of the freezer compartment 114 to the front thereof via the cool air outlet openings 120 which are provided at the partition plate 118. When freezing objects are stored at back side of the freezer compartment 114, the freezing objects block a flow of the cool air. Accordingly, the cool air cannot easily be transmitted to the front of the freezer compartment 114 so that temperature distribution inside the freezer compartment 114 does not become uniform.

SUMMARY OF THE INVENTION

The present invention is devised to solve the foregoing problems. An object of the present invention is to provide a cool air supplying apparatus capable of dispersedly supplying cool air into a freezer compartment.

To achieve the above object of the present invention, there is provided a cool air supplying apparatus for a freezer compartment of a refrigerator, the apparatus comprising:

an inner shell which surrounds the freezer compartment;

a cross flow fan assembly mounted under the inner shell inside the cooler chamber for blowing cool air generated by an evaporator;

an air distribution plate spaced apart from said inner shell by a predetermined distance inside the freezer compartment, an air distribution plate including a plurality of cool air outlet openings formed therein, each of the cool air outlet openings being disposed apart from adjacent cool air outlet openings by a predetermined distance and defining a cool air supply duct with said inner shell, and for dispersedly supplying the cool air from the cross flow fan assembly into the freezer compartment through the cool air outlet openings.

In accordance with the present invention, the cool air cooled by the evaporator is dispersedly supplied to the freezer compartment from the upper portion of the freezer compartment to the lower thereof via the cool air supply duct and the cool air outlet openings which are provided under the inner shell. Therefore, even through freezing objects are stored at back side of the freezer compartment, the cool air generated by the evaporator can be evenly transmitted to the inside of the freezer compartment so that a temperature distribution inside the freezer compartment becomes uniform.

BRIEF DESCRIPTION OF THE DRAWINGS

The above object and other advantages of the present invention will become more apparent by describing in detail preferred embodiment thereof with reference to the attached drawings in which.

DETAILED DESCRIPTION OF THE PREFERRED EMBODIMENT

Figure 1:
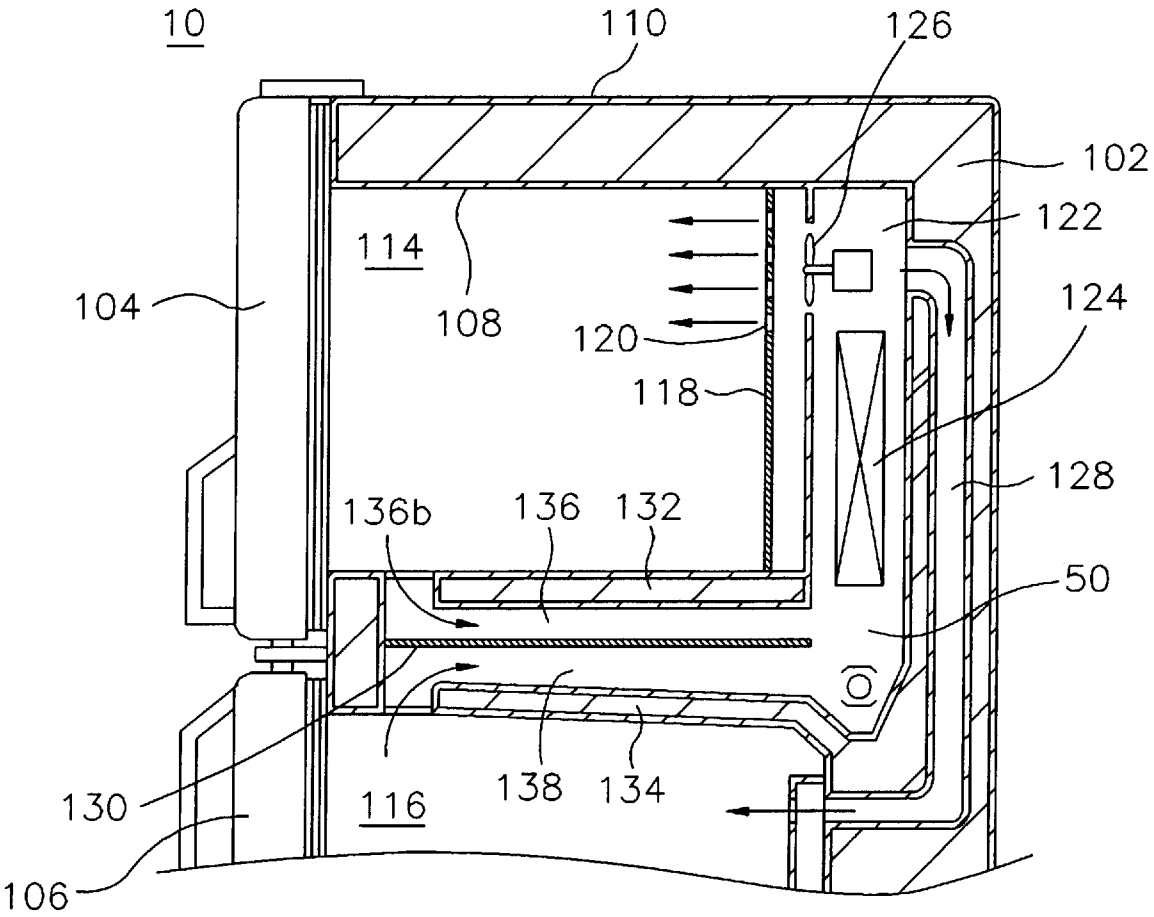
FIG. 1 PRIOR ART
FIG. 1 is a sectional side elevation for showing the construction of a conventional cool air supplying apparatus for freezer compartment of a refrigerator.
Figure 2:
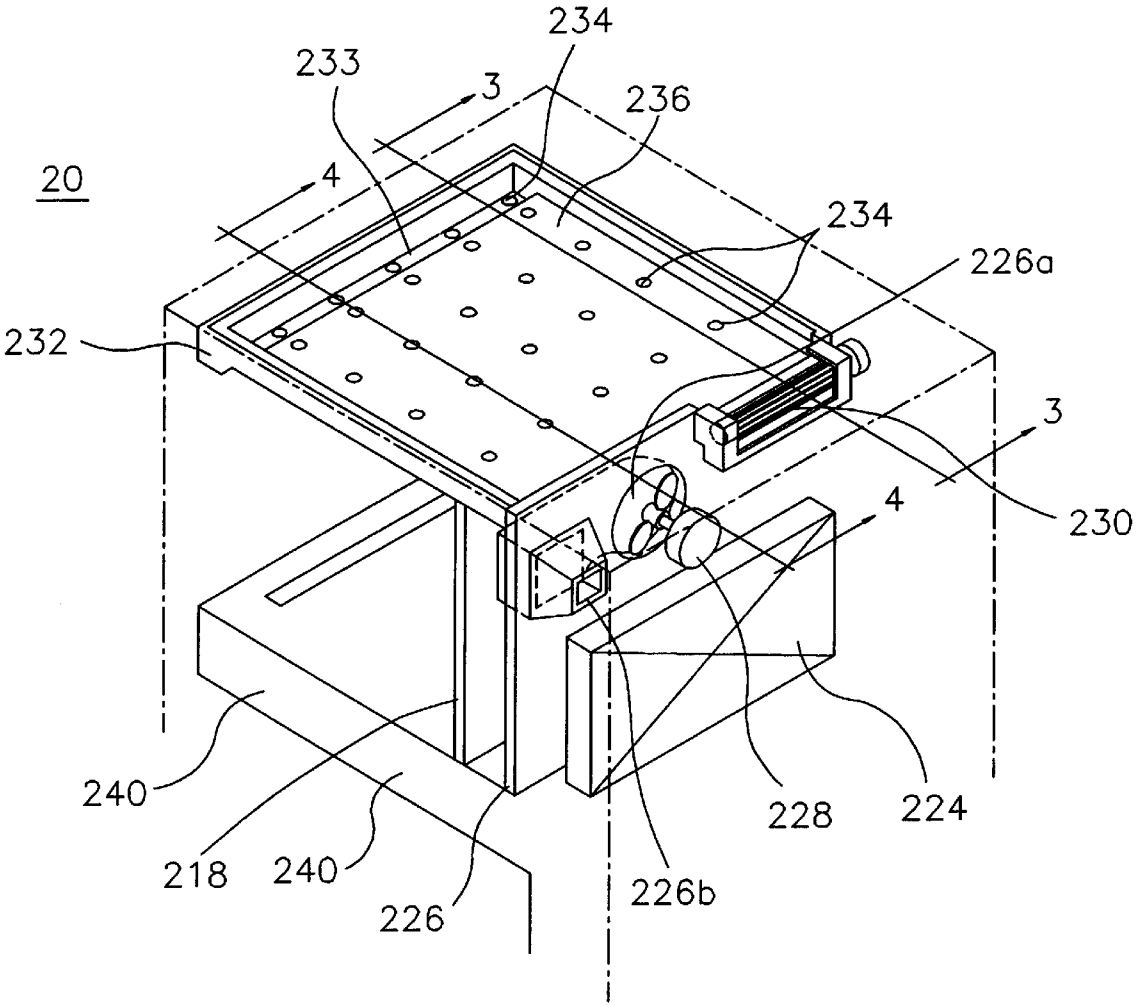
FIG. 2 is a partially cutaway view in perspective of a cool air supplying apparatus for a freezer compartment of a refrigerator according to a preferred embodiment of the present invention.
Figure 3:
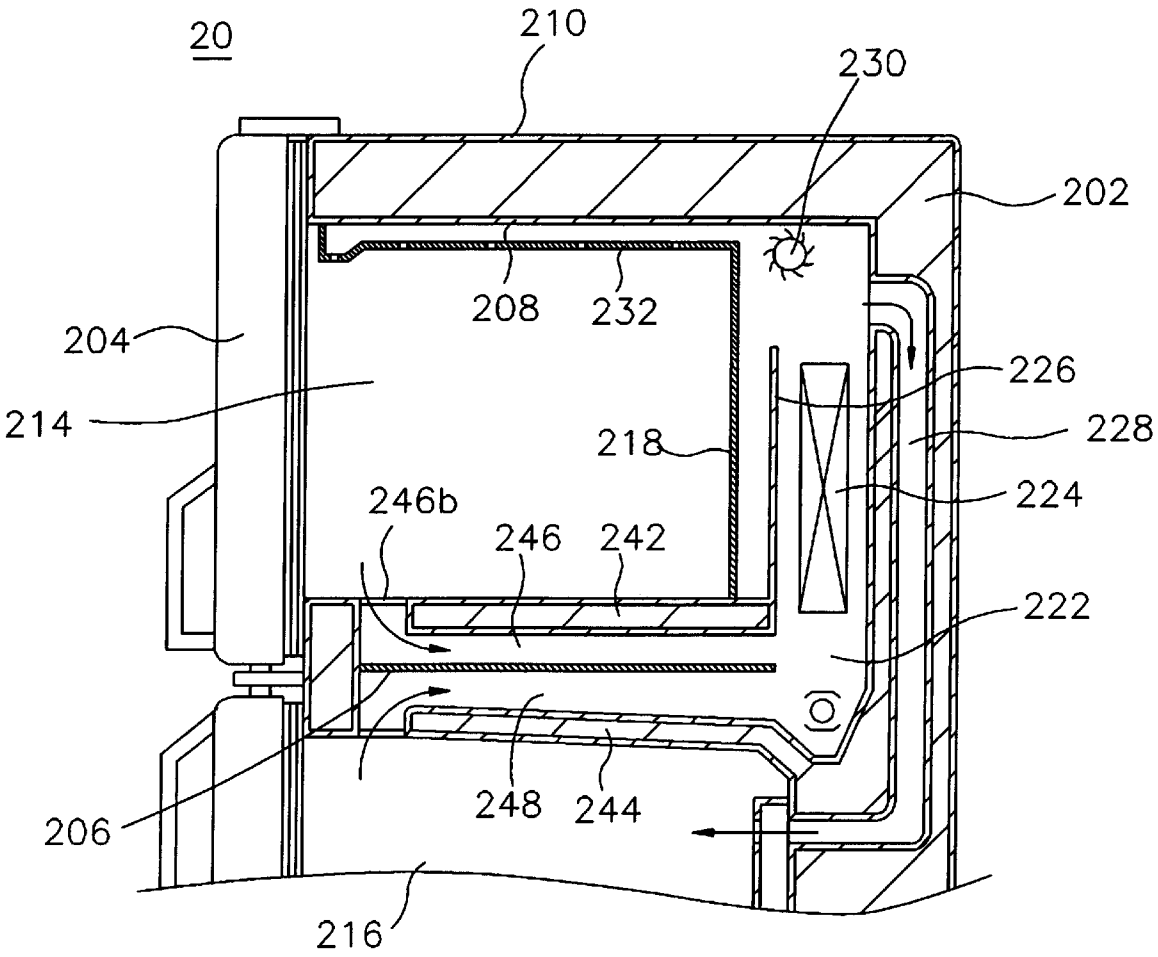
FIG. 3 is a sectional view of the cool air supplying apparatus for a freezer compartment of a refrigerator taken substantially along the lines 3—3 of FIG. 2.

Hereinafter, an embodiment of the present invention will be described in detail with reference to the accompanying drawings. FIG. 2 is a partially cutaway view in perspective of a cool air supplying apparatus for a freezer compartment of a refrigerator according to a preferred embodiment of the present invention, and FIG. 3 is a sectional view of the cool air supplying apparatus for a freezer compartment of a refrigerator taken substantially along the lines 3—3 of FIG. 2.

The cool air supply apparatus 20 includes a heat insulated housing 202 which constitutes a body of the refrigerator and first and second doors 204 and 206 for opening and closing of the heat insulated housing 202. The heat insulated housing 202 consists of an inner shell 208 made of a synthetic resin and an outer shell 210 made of metal such as a coated steel plate. The inner shell 208 is disposed above the freezer compartment 214. The first door 204 is provided for a freezer compartment 214, and the second door 206 is provided for a refrigerating compartment 216.

A partition plate 218 is vertically disposed at the back of the freezer compartment 214. Behind the partition plate 218, a cooler chamber 222 is formed. An evaporator 224 such as a cooler is provided inside the cooler chamber 222 and exchanges heat with the air returned to the cooler chamber 222 from the freezer compartment 214 through an air return outlet opening 246*b* and a freezing cool air return duct 246 (will be described later). A first louver 226 is disposed behind the partition plate 218 and including a cool air outlet opening 226*a* at a side thereof and an inlet opening 226*b* spaced apart from the cool air outlet opening 226*a* by a predetermined distance. A space 227 is defined between the partition plate 218 and the first louver 226. An air blower 228 such as a propeller fan is disposed behind the first louver 226 and above the evaporator 224 and blows cool air in a low temperature state generated from the evaporator 224 into an inside the refrigerating compartment 214 through the outlet opening 226*a* and the inlet opening 226*b* of the first louver 226, the space 227 between the partition plate 218 and the first louver 226, and the cold air duct 228.

Figure 4:
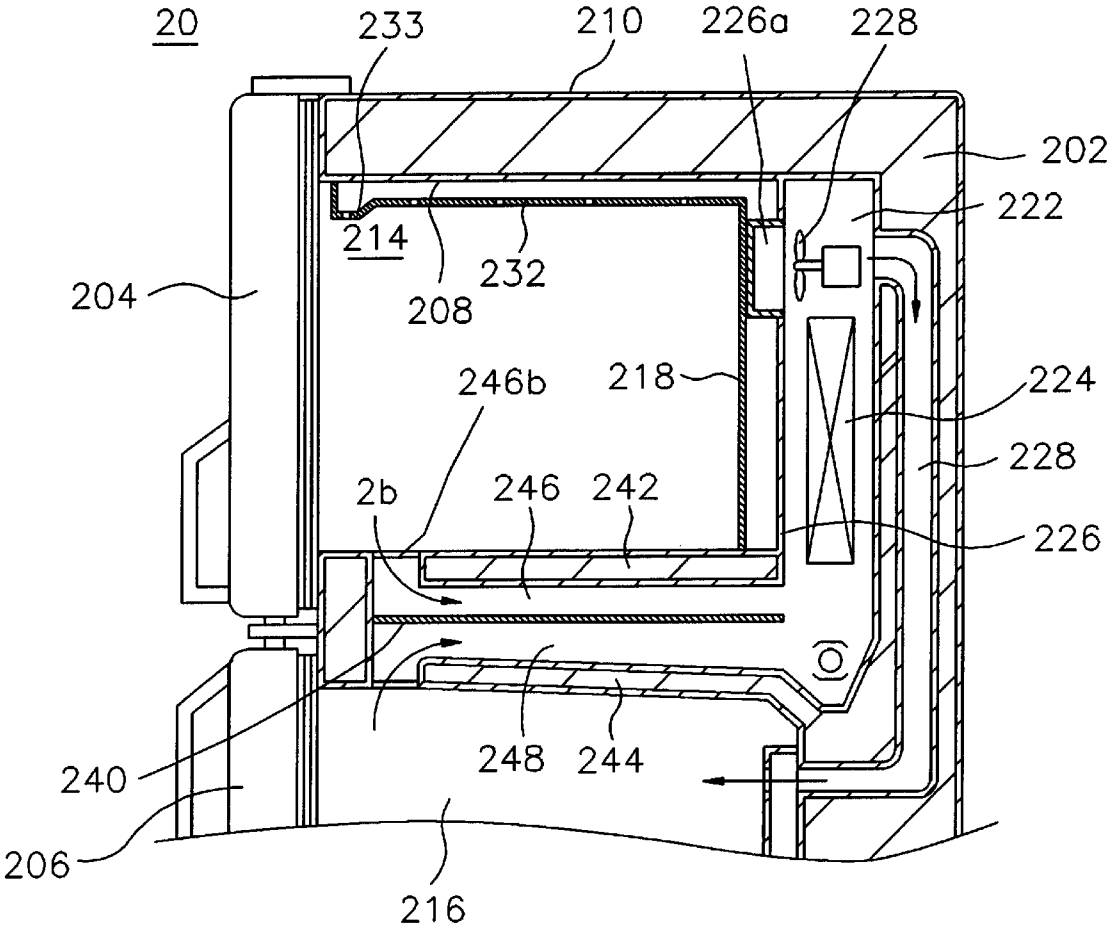
FIG. 4 is a sectional view of the cool air supplying apparatus for a freezer compartment of a refrigerator taken substantially along the lines 4—4 of FIG. 2.
Figure 5:
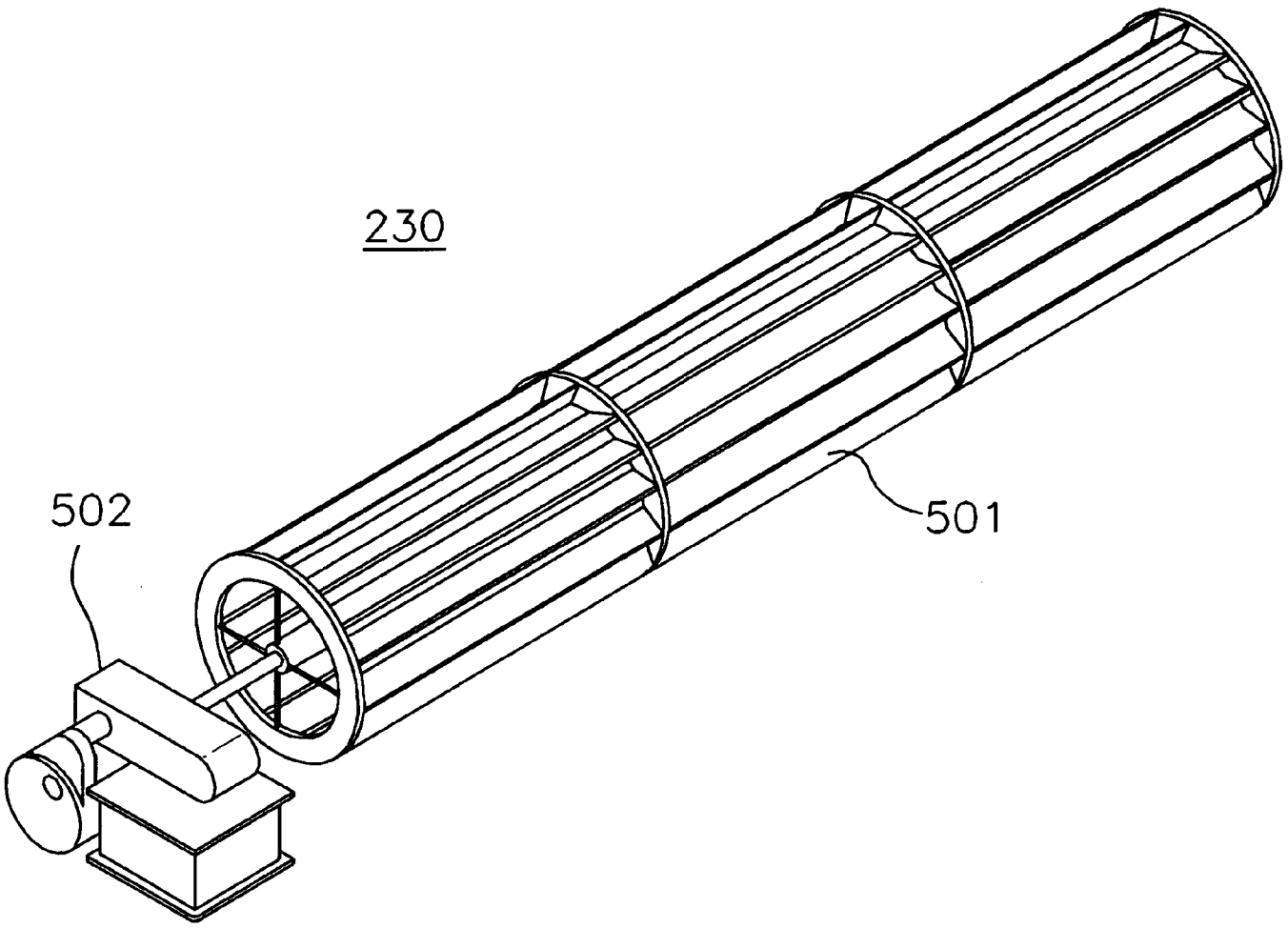
FIG. 5 is an enlarged perspective view of the cross flow fan assembly as shown in FIG. 4.

FIG. 4 is a sectional view of the cool air supplying apparatus for a freezer compartment of a refrigerator taken substantially along the lines 4—4 of FIG. 2. A cross flow fan assembly 230 is mounted in the gap at suitable distance apart from the evaporator 224 inside the cooler chamber 222 and blows the cool air in a low temperature state generated from the evaporator 224 through a cool air supply duct 236. FIG. 5 is an enlarged perspective view of the cross flow fan assembly 230 shown in FIG. 4. The cross flow fan assembly 230 includes a plurality of cross flow fan blades 501 for blowing the cool air from the evaporator 224 into the cool air supply duct air 236, a motor 502 connected to rotate the cross flow fan blades 501, and a housing 503 for receiving the cross flow fan blades 501 and the motor 502.

An air distribution plate 232 is spaced apart from the inner shell 208 by a predetermined distance inside the freezer compartment 214. The air distribution plate 232 includes a plurality of cool air outlet openings 234 formed therein, each of the outlet openings 234 being disposed apart from adjacent outlet openings by a predetermined distance. A cool air supply duct 236 is defined between the inner shell 208 and the air distribution plate 232. The air distribution plate 232 dispersedly supplies the cool air which is provided into the cool air supply duct 236 from the flow fan assembly 230 into the freezer compartment 214 through the outlet openings 234. The air distribution plate 232 further includes a recess 233 horizontally formed on a front upper bottom thereof so that the cool air supplied on the recess 233 from the cross flow fan assembly 230 is convergently supplied toward an entrance of the freezer compartment 214 through the cool air outlet openings 234.

A cold air duct 238 extends from the freezer compartment 214 to the refrigerating compartment 216 in the longitudinal direction of the refrigerator along an inner wall thereof. In order for the cool air generated from the evaporator 226 to flow, a cool air flow passage is provided from the cold air duct 228 installed with the evaporator 226 therein, which is then communicated with the freezer compartment 214 and the refrigerating compartment 216.

A reference numeral 240 designates a horizontal partition for dividing an inner space of the heat insulating housing 202 into two section, i.e., upper and lower sections. The section over the horizontal partition 240 serves as the freezer compartment 214 that is cooled to a freezing temperature (e.g., about −20° C.), and the section under the horizontal partition 230 serves as the refrigerating compartment 216 that is cooled to a temperature (e.g., about 3° C.) at which foods do not freeze. A first separating plate 242 is installed to the bottom of the freezer compartment 214, and a second separating plate 244 is installed to the top of the refrigerating compartment 216. A freezing cool air return duct 246 is formed between the first separating plate 242 and the horizontal partition 240, and a refrigerating cool air return duct 248 is formed between the horizontal partition 240 and the second separating plate 244.

An operation of the cool air supply apparatus for a freezer compartment of a refrigerator according to the present invention will now be explained. When the evaporator 224 generates cool air inside the cooler chamber 222, the cross flow fan assembly 230 blows the cool air from the evaporator 224 into the cool air supply duct 236. Accordingly, the cool air guided into the cool air supply duct 236 is dispersedly supplied into the freezer compartment 214 via cool air outlet openings 234 in such a manner that the cool air is supplied from an upper portion to a lower portion of the freezer compartment 214. The cold air supplied into the freezer compartment 214 is returned to the cooler chamber 222 via the freezing cool air return duct 236. The cool air is again cooled by means of the evaporator 224 so that circulation of the cool air repeats.

In accordance with the cool air supply apparatus for a freezer compartment of a refrigerator according to the present invention, the cool air cooled by the evaporator is dispersedly supplied to the freezer compartment from the upper portion of the freezer compartment 214 to the lower thereof via the cool air supply duct 236 and the cool air outlet openings 234 which are provided under the inner shell 208. Therefore, even through freezing objects are stored at back side of the freezer compartment 214, the cool air generated by the evaporator can be evenly transmitted to the inside of the freezer compartment 214 so that a temperature distribution inside the freezer compartment 214 becomes uniform.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A cool air supplying apparatus for a freezer compartment of a refrigerator, said apparatus comprising:

an inner shell which surrounds the freezer compartment;

a cross flow fan assembly mounted under said inner shell inside a cooler chamber for blowing cool air generated by an evaporator;

an air distribution plate spaced apart from said inner shell by a predetermined distance inside the freezer compartment, said air distribution plate including a plurality of cool air outlet openings formed therein, each of the cool air outlet openings being disposed apart from adjacent cool air outlet openings by a predetermined distance and defining a cool air supply duct with said inner shell, and for dispersedly supplying the cool air from said cross flow fan assembly into the freezer compartment through the outlet openings in such a manner that the cool air is supplied from an upper portion to a lower portion of the freezer compartment.

2. The apparatus in accordance with claim 1, wherein said cross flow fan assembly includes cross flow fan blades for flowing the cool air from said evaporator into said air distribution plate, a motor connected to said cross flow fan blades for rotating said cross flow fan blades, and a housing for receiving the cross flow fan blades and the motor.

3. The apparatus in accordance with claim 1, wherein said air distribution plate further includes a recess horizontally formed on a front upper bottom of said air distribution plate so that the cool air supplied in the cool air supply duct through the recess from said cross flow fan assembly is convergently supplied toward an entrance of the freezer compartment through the cool air outlet openings of said air distribution plate.

4. A cool air supplying apparatus for a freezer compartment of a refrigerator, said apparatus comprising:

an inner shell which surrounds the freezer compartment;

a cross flow fan assembly mounted under said inner shell inside a cooler chamber for blowing cool air generated by an evaporator, said cross flow fan assembly including cross flow fan blades for flowing the cool air from said evaporator into a cool air supply duct, and a motor connected to said cross flow fan blades for rotating said cross flow fan blades;

an air distribution plate spaced apart from said inner shell by a predetermined distance inside the freezer compartment, said air distribution plate including a plurality of cool air outlet openings formed therein, each of the cool air outlet openings being disposed apart from adjacent outlet openings by a predetermined distance and a recess horizontally formed on a front upper bottom of said air distribution plate so that the cool air supplied in the cool air supply duct through the recess from said cross flow fan assembly is convergently supplied toward an entrance of the freezer compartment through the cool air outlet openings, for defining the cool air supply duct with said inner shell, and for dispersedly supplying the cool air from said cross flow fan assembly into the freezer compartment through the cool air outlet openings in such a manner that the cool air is supplied from an upper portion to a lower portion of the freezer compartment.

* * * * *